US011815100B2

(12) United States Patent
Watson

(10) Patent No.: US 11,815,100 B2
(45) Date of Patent: Nov. 14, 2023

(54) FLUID LEAK DIVERTER

(71) Applicant: Billy Dean Watson, Whitney, TX (US)

(72) Inventor: Billy Dean Watson, Whitney, TX (US)

( * ) Notice: Subject to any disclaimer, the term of this patent is extended or adjusted under 35 U.S.C. 154(b) by 67 days.

(21) Appl. No.: 17/218,667

(22) Filed: Mar. 31, 2021

(65) Prior Publication Data

US 2021/0310496 A1 Oct. 7, 2021

Related U.S. Application Data

(60) Provisional application No. 63/003,340, filed on Apr. 1, 2020.

(51) Int. Cl.
*F04D 27/00* (2006.01)
*F04D 29/12* (2006.01)
*F04D 29/08* (2006.01)

(52) U.S. Cl.
CPC ..... *F04D 27/001* (2013.01); *F04D 27/008* (2013.01); *F04D 29/08* (2013.01); *F04D 29/12* (2013.01)

(58) Field of Classification Search
CPC .... F04D 13/021; F04D 27/001; F04D 27/008; F04D 29/08; F04D 29/10; F04D 29/104; F04D 29/108
See application file for complete search history.

(56) References Cited

U.S. PATENT DOCUMENTS

| | | | | | |
|---|---|---|---|---|---|
| 2,386,898 | A * | 10/1945 | Karassik | F04D 7/04 | 415/113 |
| 5,642,892 | A * | 7/1997 | Burgess | F16J 15/24 | 277/516 |
| 6,311,984 | B1 * | 11/2001 | Orlowski | F16J 15/004 | 277/420 |
| 7,114,726 | B2 * | 10/2006 | Murray | F04D 29/108 | 277/510 |
| 7,857,321 | B2 * | 12/2010 | Roddis | F16J 15/4478 | 277/412 |
| 9,140,366 | B2 * | 9/2015 | Ferris | F16J 15/3464 | |
| 9,957,828 | B2 * | 5/2018 | Kosmicki | F01D 17/08 | |
| 10,927,961 | B2 * | 2/2021 | Hoehle | F16J 15/4474 | |

* cited by examiner

*Primary Examiner* — Juan G Flores
*Assistant Examiner* — Jason G Davis
(74) *Attorney, Agent, or Firm* — Nolte Lackenbach Siegel

(57) ABSTRACT

A fluid diverter that utilizes a gland seal. The gland seal includes a stationary seat, a first O-ring, a rotating seal face, a second O-ring, a plurality of tabs, and a spring retainer. The fluid diverter may also include a one-piece bearing isolator. The one-piece bearing isolator includes a stator having a first end, a first set of O-rings, a second set of O-rings, and a second end. The one-piece bearing isolator also includes a rotor seated in the stator, the rotor including a recess, an O-ring positioned in the recess, and a lip extending over and hugging the stator. The fluid leak diverter utilizes the gland seal and one-piece bearing isolator to direct leaked liquid fluid away from a pump (and functional components of the pump such as bearings).

13 Claims, 15 Drawing Sheets

A method for sealing a pump

| | |
|---|---|
| 600 | Providing a gland seal about the rotating shaft of a pump |
| 601 | Diverting leakage through an outlet port in the gland seal through which leaked fluid drains out into a containment vessel |
| 602 | Providing a one-piece bearing isolator about the rotating shaft of a pump, located downstream from the gland seal |
| 603 | Diverting leakage through a slot in the one-piece bearing isolator through which leaked fluid drains out into a containment vessel |

FIG. 6A

| | |
|---|---|
| 604 | Providing a sealing set adjacent to the gland seal through which leaked fluid drains out into a containment vessel |

FIG. 6B

FLUID LEAK DIVERTER

CROSS-REFERENCE TO RELATED APPLICATIONS

This application claims priority to U.S. Provisional Patent Application No. 63/003,340, entitled "Fluid Leak Diverter," filed Apr. 1, 2020, by Billy Dean Watson. This application claims priority to and incorporates by reference, in its entirety, the above referenced provisional application.

BACKGROUND

Pumps are used for moving various fluids that include liquids such as water, gasoline, oil, or gasses such as oxygen, nitrogen, or simply air (which is a composite of other gasses). During the pumping process, many fluids can leak from the pump. One place where leaks may form is around seals, such as mechanical seals, or packing. When a mechanical seal or packing in a pump starts leaking, the leaking fluid, if in liquid form, may travel down the shaft and into the bearings of the pump. As the liquid fluid leaks from the shaft, it may also spread to other parts of the pump. Such a leak can cause pump failure and also cause the bearings to go out. If the leaking liquid fluid is corrosive, it can corrode the pump, causing expensive repairs or replacement.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

FIG. 6A-B are flowcharts depicting example methods for sealing a pump, according to one or more examples of the disclosure.

Figure 1:
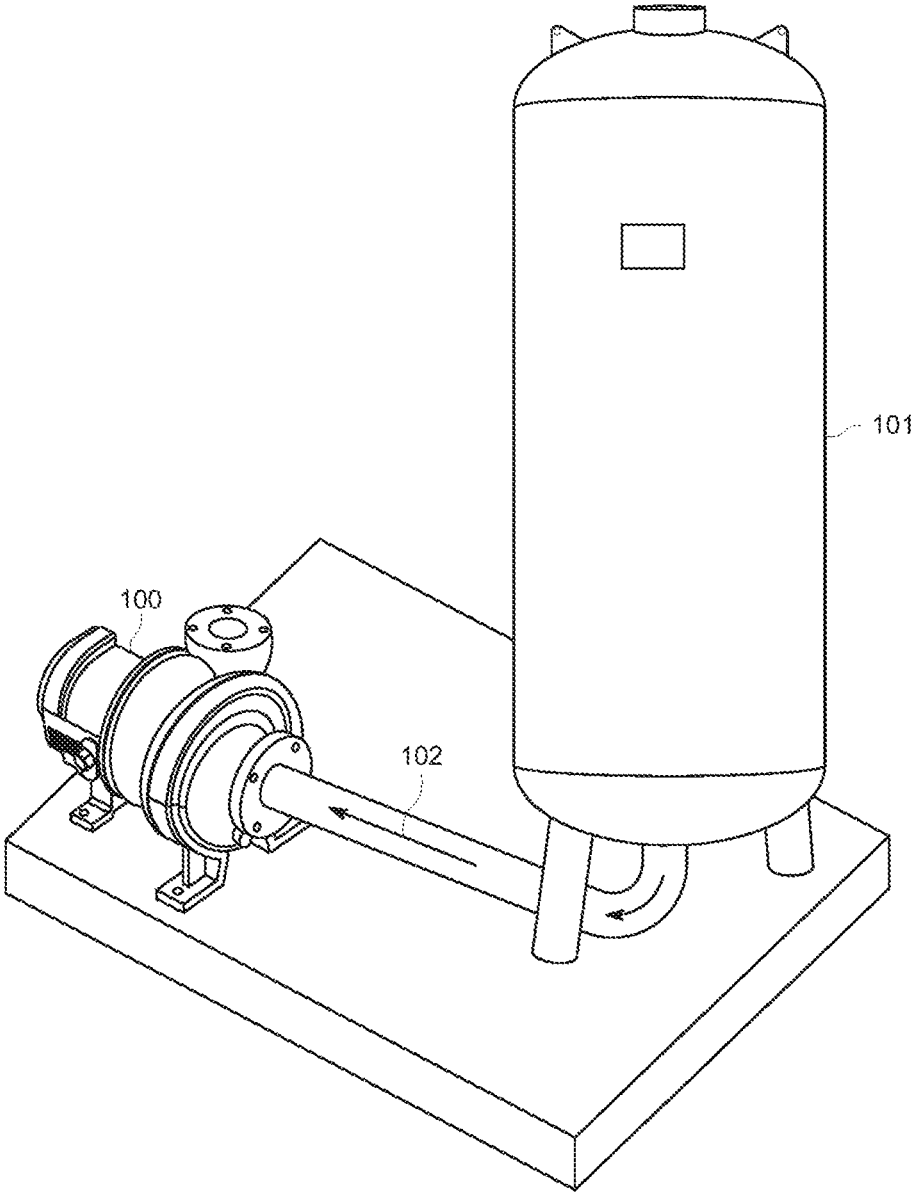
FIG. 1 depicts a pump with fluid leak diverter connected to a well, according to one or more examples of the disclosure.

While the embodiments disclosed herein are susceptible to various modifications and alternative forms, the drawings illustrate specific embodiments herein described in detail by way of example. It should be understood, however, that the description herein of specific embodiments is not intended to limit this disclosure to the particular forms disclosed, but on the contrary, the intent is to cover all modifications, equivalents, and alternatives falling within the spirit and scope of the appended claims.

DETAILED DESCRIPTION

It is to be understood that the following disclosure describes several example embodiments for implementing different features, structures, or functions of the fluid leak diverter. Example embodiments of components, arrangements, and configurations are described below to simplify the present disclosure. However, these example embodiments are provided merely for purposes of explanation and understanding of this disclosure. Example embodiments of this disclosure are not intended to limit the scope of the claims of this application.

Additionally, the present disclosure may repeat reference numerals and/or letters in the various illustrated embodiments and across the Figures provided herein. This repetition is for the purpose of simplicity and clarity and does not necessarily in itself dictate a relationship between the various embodiments and/or configurations discussed in the various Figures.

Moreover, the formation of a first feature over or on a second feature in the description that follows may include embodiments in which the first and second features are formed in direct contact. Alternatively, the formation may also include embodiments in which additional features may be formed interposing the first and second features, such that the first and second features may not, be in direct contact.

Finally, the embodiments presented below may be combined in any combination or ways, i.e., any elements from one embodiment may be used in any other embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of this disclosure, unless otherwise specifically defined herein. Further, the naming convention used herein is not intended to distinguish between components that differ in name but not function.

Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, I.e. "A or B" is intended to be synonymous with "at least one of A and B" unless otherwise expressly specified herein.

One goal of the present apparatus is to mitigate leakage problems in pumps. More specifically, the disclosed fluid leak diverter may be useful when the pump is pumping a liquid fluid or a gas that liquifies upon leakage. Accordingly, when there is a leak from a seal or any kind of sealing device, the leakage may be contained and diverted to a containment vessel where it does not affect the environment, the pump equipment, or other internal components of the pump. In some embodiments, an alarm may alert an operator to the presence of the leak. The operator of the pump may then choose to either shut down the pump or take some other action.

The fluid leak diverter as disclosed herein may be used in centrifugal pumps or regular pumps. The disclosed apparatus is not specifically designed to prevent any leakage at all. However, if a leakage does occur, one goal of the fluid leak diverter is to redirect leakage to containment or away from the pump and, in some embodiments, to notify the pump operators of when the leakage starts. Of course, the disclosed apparatus may be designed to minimize leaks while also providing the stated goals of detecting and redirection.

Embodiments of the disclosure provide a gland seal. The gland seal includes a stationary seat. The stationary seat defines an opening, a recess circumscribing the interior of the opening, a first groove adjacent to the recess and circumscribing the interior of the opening, an inset surrounding the opening, an inlet port where pressurized fluid enters the seal, and an outlet port where leaked fluid exits the seal. The gland seal also includes a first O-ring disposed in the first groove, a rotating seal face disposed in the recess, a second O-ring disposed in the inset, a plurality of tabs disposed in the inset, and a spring retainer. A plurality of springs is disposed on the spring retainer as well as a plurality of slots configured to mate with the pair of tabs.

Embodiments of the disclosure may further provide a one-piece bearing isolator defining a bore. The one-piece bearing isolator includes a stator having a first end. The first end of the stator defines a first set of grooves on the outside of the stator and a second set of grooves on the inside of the stator. The stator also includes a first set of O-rings positioned in the first set of grooves, each of the first set of O-rings being positioned in a respective one of the first set of grooves, and a second set of O-rings positioned in the second set of grooves, each of the second set of O-rings being positioned in a respective one of the second set of grooves. The stator also includes a second end. The second end of the stator includes a head defining a slot positioned on the side of the head through which leaked fluid flows. The stator also includes a rotor seated in the head of the stator. The rotor includes a recess circumscribing the interior of the rotor, an O-ring positioned in the recess, and a lip extending over and hugging the head of the stator. The bearing isolator is a non-contact and non-wearing leak diverting device.

Embodiments of the disclosure may still further provide a pump. The pump includes a motor positioned at one end of the pump, a shaft rotatable by the motor, an impeller including a plurality of blades, the blades mounted on and rotatable by the shaft, a shaft sleeve to protect the shaft as it passes through the pump, a plurality of bearings, packing, a discharge, and a gland seal. The gland seal includes a stationary seat. The stationary seat defines an opening, a recess circumscribing the interior of the opening, a first groove adjacent to the recess and circumscribing the interior of the opening, an inset surrounding the opening, an inlet port where pressurized fluid enters the seal, and an outlet port where leaked fluid exits the seal. The gland seal also includes a first O-ring disposed in the first groove, a rotating seal face disposed in the recess, a second O-ring disposed in the inset, a pair of tabs disposed in the inset, and a spring retainer. A plurality of springs is disposed on the spring retainer as well as a pair of slots configured to mate with the pair of tabs in the inset. The mating tabs of the inset and slots of the spring retainer may be reversed (i.e., slots on the inset and tabs on the spring retainer) or any number of tabs and slots may be used.

The pump also includes a one-piece bearing isolator. The one-piece bearing isolator defines a bore and includes a stator having a first end. The first end of the stator defines a first set of grooves on the outside of the stator and a second set of grooves on the inside of the stator. The stator also includes a first set of O-rings positioned in the first set of grooves, each of the first set of O-rings being positioned in a respective one of the first set of grooves, and a second set of O-rings positioned in the second set of grooves, each of the second set of O-rings being positioned in a respective one of the second set of grooves. The stator also includes a second end. The second end of the stator includes a head defining a slot positioned on the side of the head through which leaked fluid flows. The stator also includes a rotor seated in the head of the stator. The rotor includes a recess circumscribing the interior of the rotor, an O-ring positioned in the recess, and a lip extending over and hugging the head of the stator. The gland seal and the one-piece bearing isolator work together to divert leaked fluid away from the pump.

Embodiments of the disclosure may also provide a method for sealing in a pump. The method includes providing a gland seal about the rotating shaft of a pump. The method also includes diverting leakage through an outlet port in the gland seal through which leaked fluid drains out into a containment vessel. The method further includes providing a one-piece bearing isolator about the rotating shaft of a pump, located downstream from the gland seal. The method also includes diverting leakage through a slot in the one-piece bearing isolator through which leaked fluid drains out into a containment vessel.

Turning now to the drawings, reference to the FIGs. will provide illustrative examples of the subject matter claimed below. In the interest of clarity, not all features of an actual implementation are described for every example in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

FIG. 1 illustrates one embodiment of a pump 100. Pump 100 is shown connected to a tank 101. The direction of fluid flow is from tank 101 into pump 100 as indicated by arrow 102. Tank 101, in use, may be filled with any fluid (not shown) and in some embodiments some aspects of pump 100 may be adapted to accommodate the nature of the fluid. In this example, pump 100 includes a fluid leak diverter (not visible in FIG. 1), which includes a gland seal 200, first shown in FIG. 2 and in greater detail in FIG. 3A-3E, and/or one or more one-piece bearing isolators 298, also first shown in FIG. 2 and in greater detail in FIG. 5A.

Figure 2:
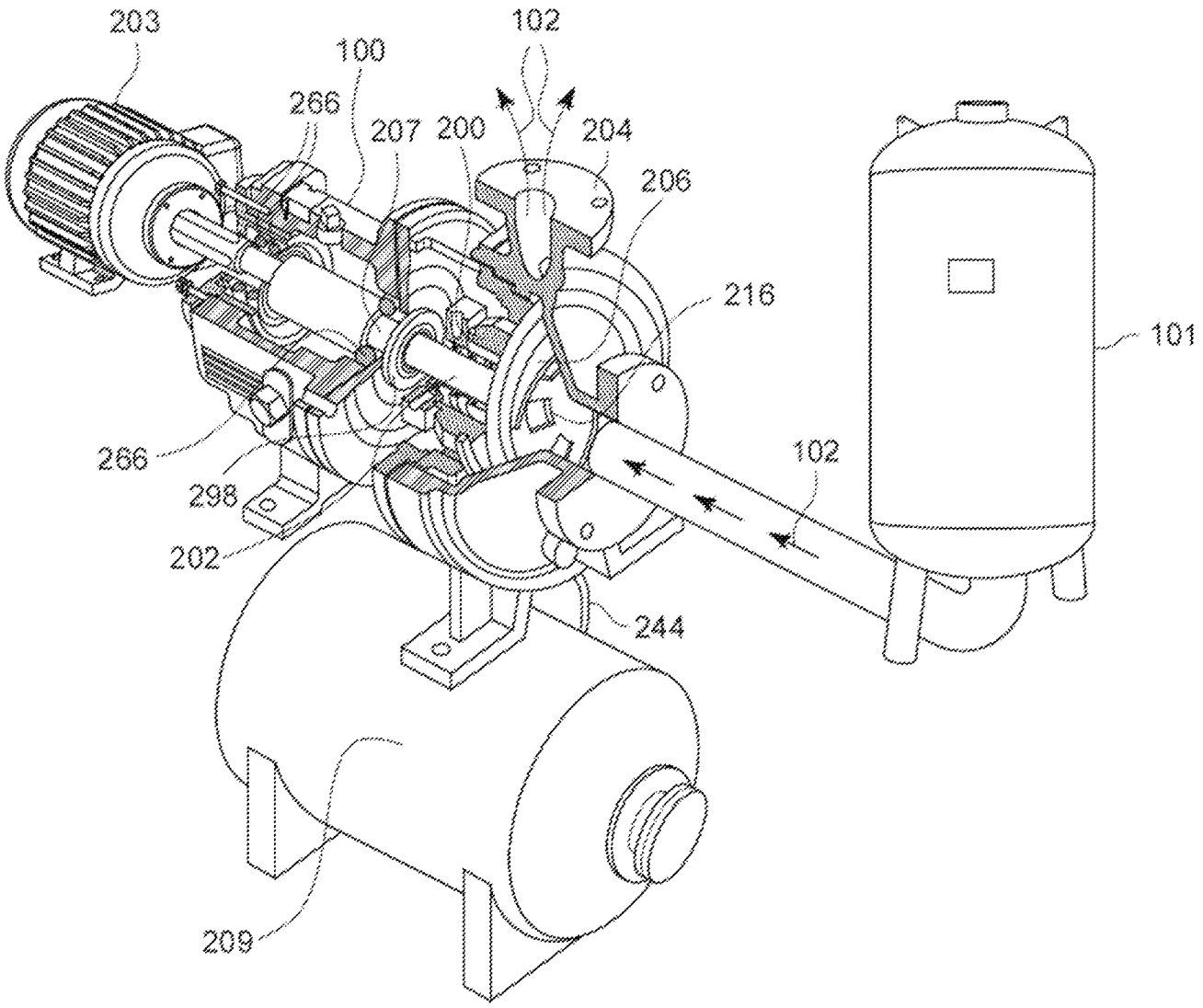
FIG. 2 illustrates a partially cross-sectioned view of the base structure of the pump of FIG. 1 with a fluid leak diverter, according to one or more examples of the disclosure.

FIG. 2 is a partially sectioned view of pump 100 connected to tank 101 as shown in FIG. 1. In this example, pump 100 has a motor 203 positioned at one end of pump 100, a pump shaft 207 rotatable by motor 203, and an impeller 206. Impeller 206 has a plurality of blades 216 which are mounted on and rotatable by pump shaft 207. Pump 100 also has a shaft sleeve 202 to protect pump shaft 207 as it passes through pump 100. Pump 100 also includes a plurality of bearings 266, a packing, and a discharge nozzle 204.

As mentioned above, in this example, pump 100 includes a fluid leak diverter, which includes gland seal 200 and one-piece bearing isolator 298. Gland seal 200 (which is shown in more detail in FIG. 3A-E) has a stationary seat 300 defining an opening 301, a recess 302 circumscribing the interior of opening 301. A first groove 303 is illustrated adjacent to recess 302 and circumscribes the interior of opening 301. Inset 304 surrounds opening 301 interior to recess 302. Inlet port 305 (from FIG. 3C) indicates where pressurized fluid may enter gland seal 200. Outlet port 306 (from FIG. 3D) indicates where leaked fluid may exit gland seal 200 as described.

Figure 3A:
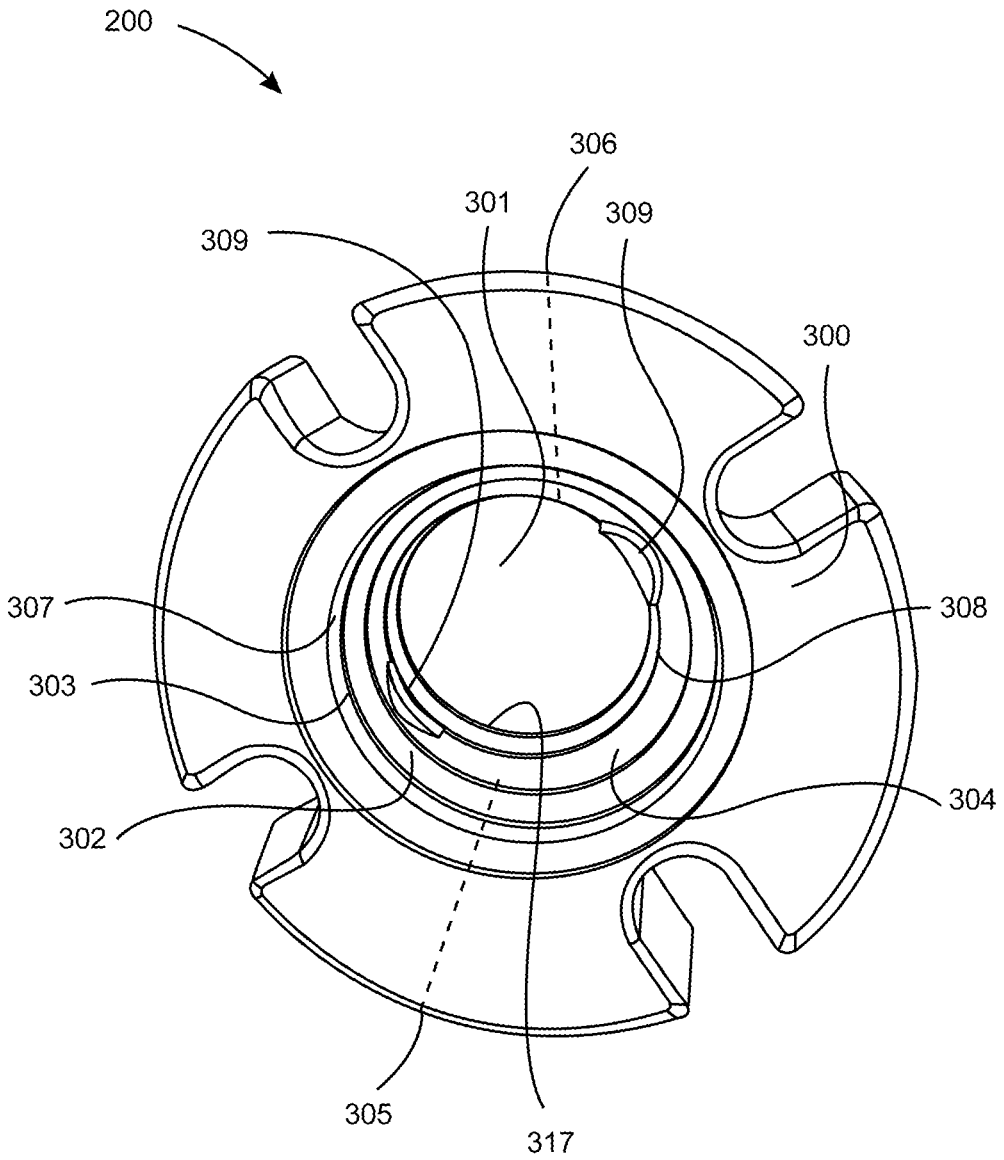
FIG. 3A-3D depicts a gland seal in top, bottom, first side, and second side views, respectively, according to one or more examples of the disclosure.
Figure 3B:
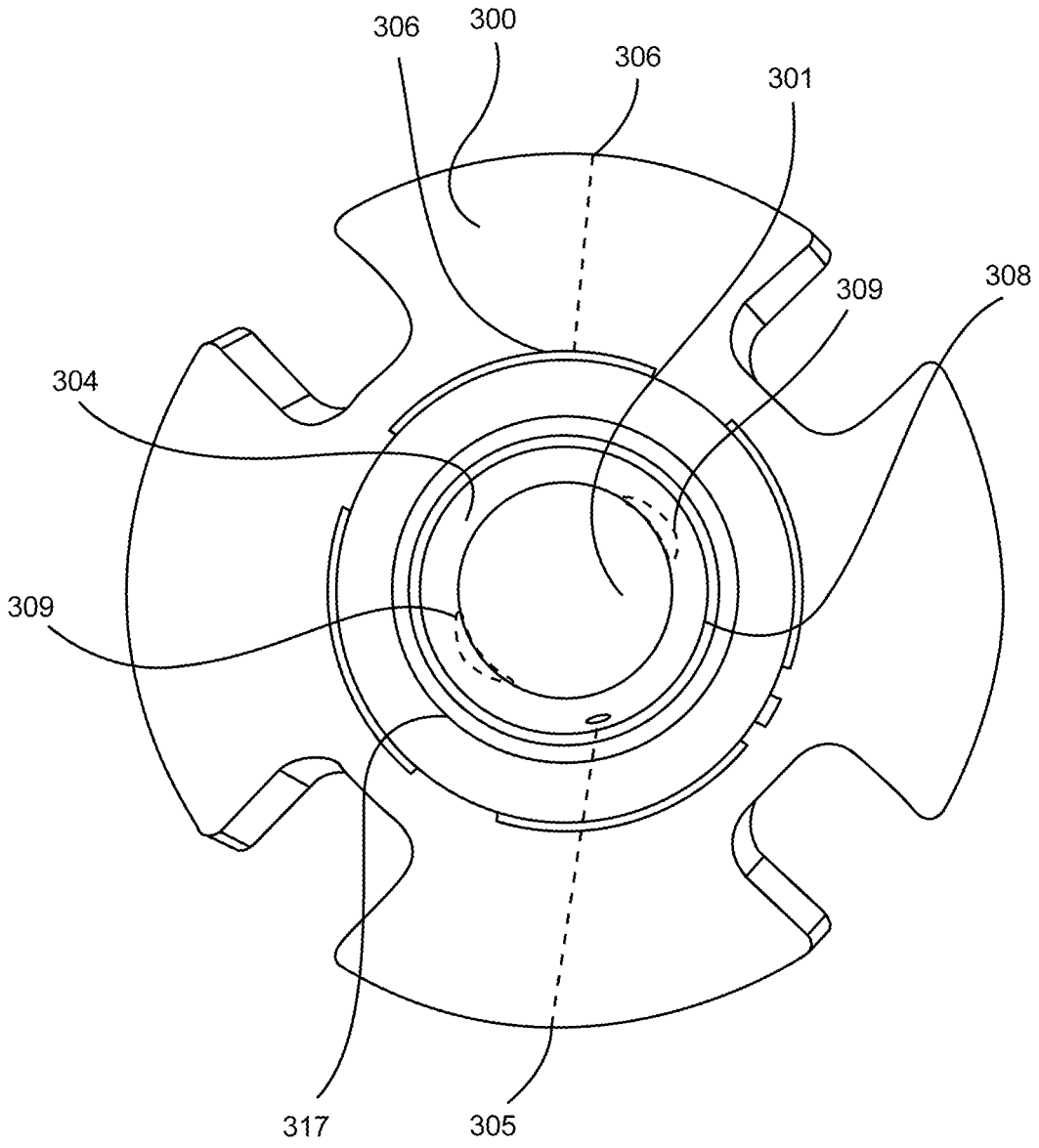
Figure 3C:
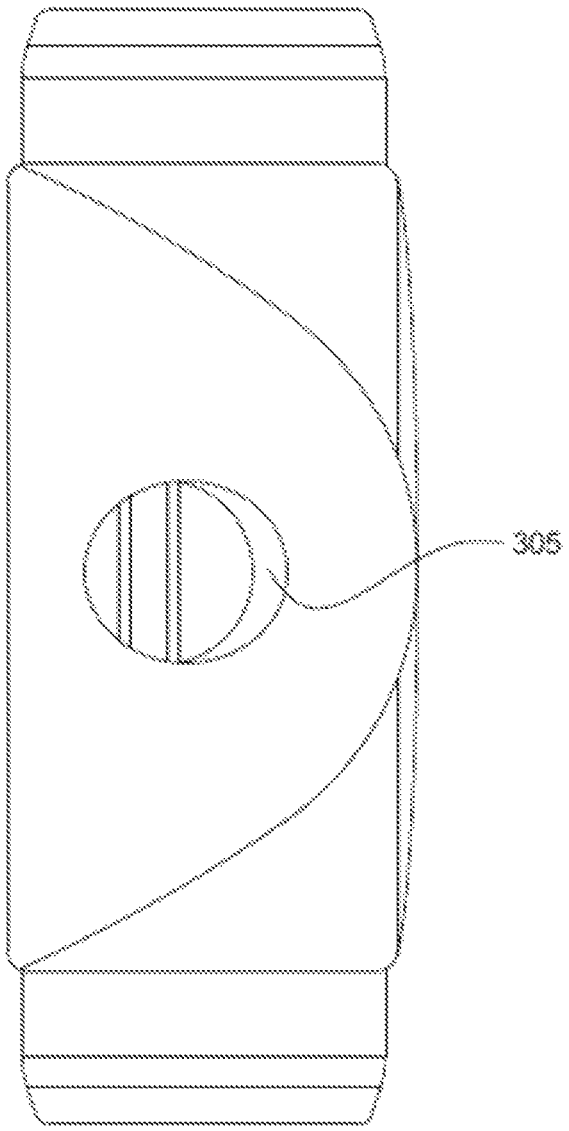
Figure 3D:
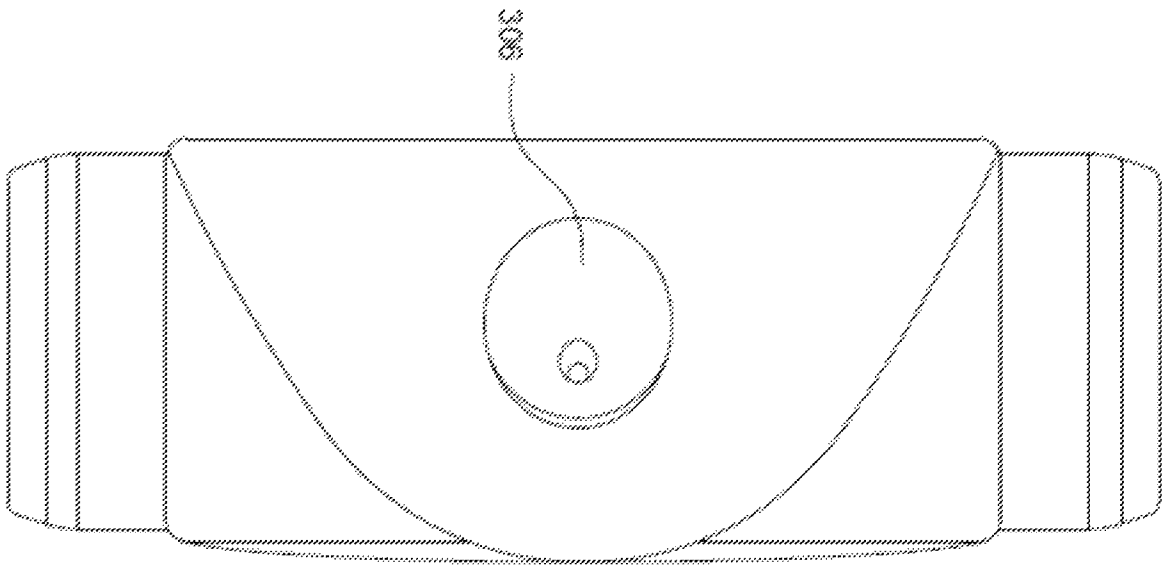
Figure 3E:
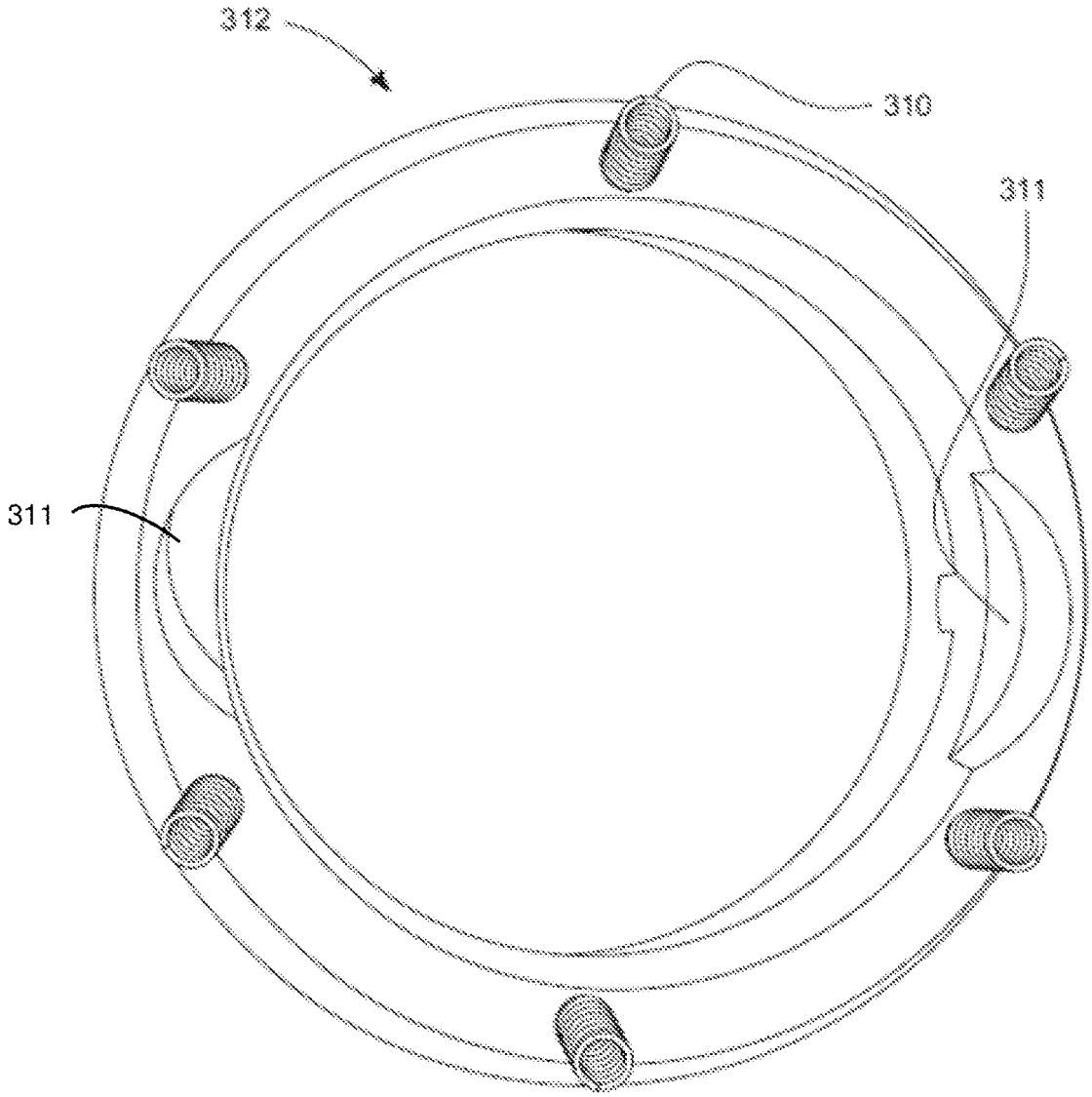
FIG. 3E depicts a spring retainer, according to one or more examples of the disclosure.

Referring collectively to FIG. 2 and FIGS. 3A-3B, gland seal 200 may be fitted onto pump shaft 207 by inserting pump shaft 207 through opening 301.

Gland seal 200 also includes the first O-ring 307 disposed in first groove 303 adjacent recess 302. Rotating seal face 317 is disposed interior to recess 302 and second O-ring 308 is disposed in inset 304. A pair of tabs 309 is also disposed on opposing sides of inset 304. Spring retainer 312 (FIG. 3E) includes the plurality of springs 310 disposed on the spring retainer 312 and a plurality of slots 311 configured to mate with the pair of tabs 309 on inset 304 when forming gland seal 200. The first O-ring 307, rotating seal face 317, and second O-ring 308 cooperate to provide a seal about pump shaft 207 when gland seal 200 is mounted to pump shaft 207. As mentioned above tabs 309 and slots 311 may be reversed such that inset 304 has slots rather than tabs and any number of complementary tabs/slots may be used to mate spring retainer 312 to inset 304.

Figure 4A:
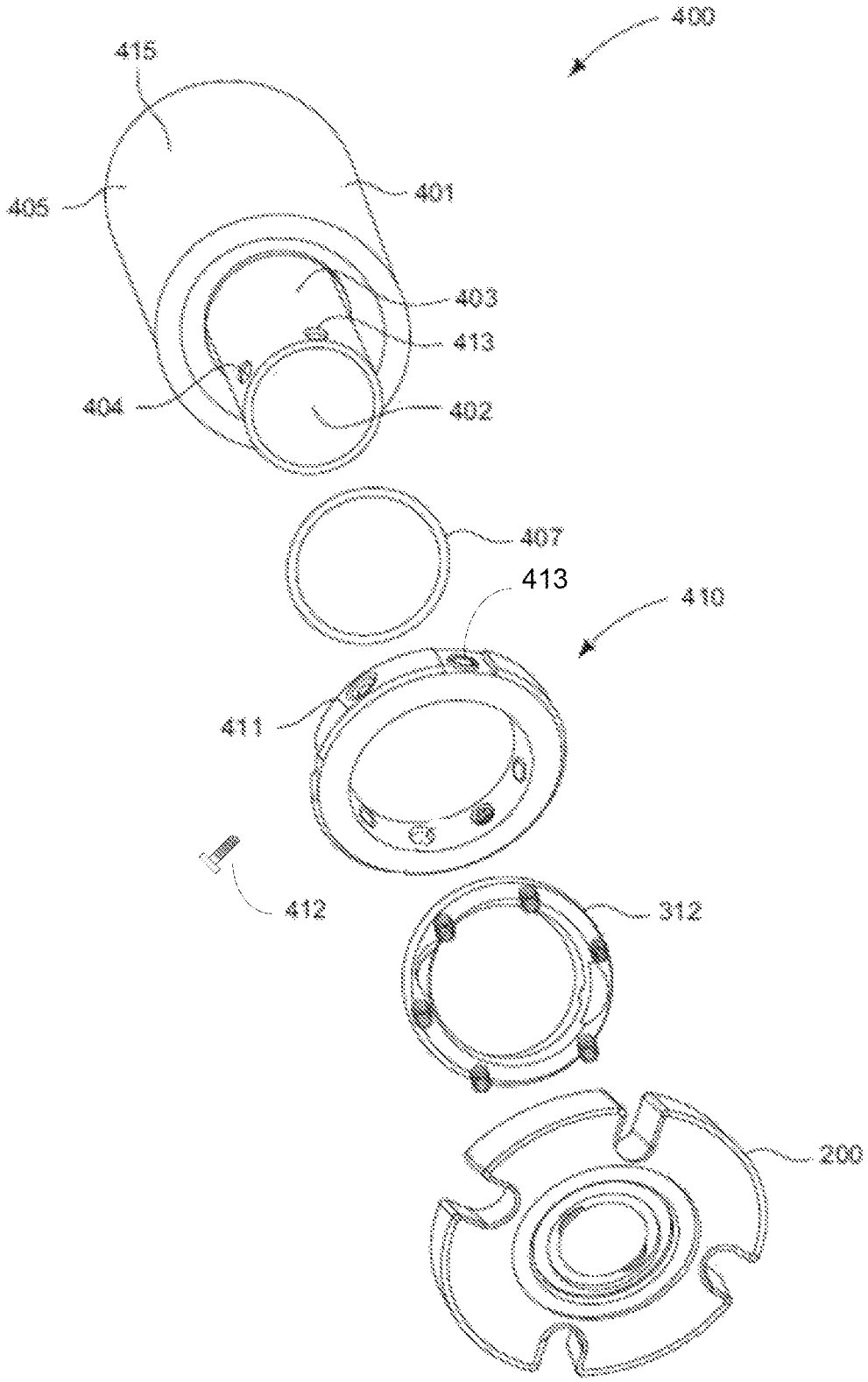
FIG. 4A depicts an exploded view of a sealing set, according to one or more examples of the disclosure.

Gland seal 200 is illustrated to be coupled with a sealing set 400 as shown in FIG. 4A. The gland seal 200 and the sealing set 400 may be made of nylon. Sealing set 400 includes sealing ring 401 defining bore 402. Sealing ring 401 also includes tubular body 403 with a circular body surrounding bore 402 to maintain bore 402 as an opening through gland seal 200. Tubular body 403 further includes a first end 404 defining a plurality of holes 413 with sealing ring 401 having a second end 405 that is opposite first end 404.

Figure 4B:
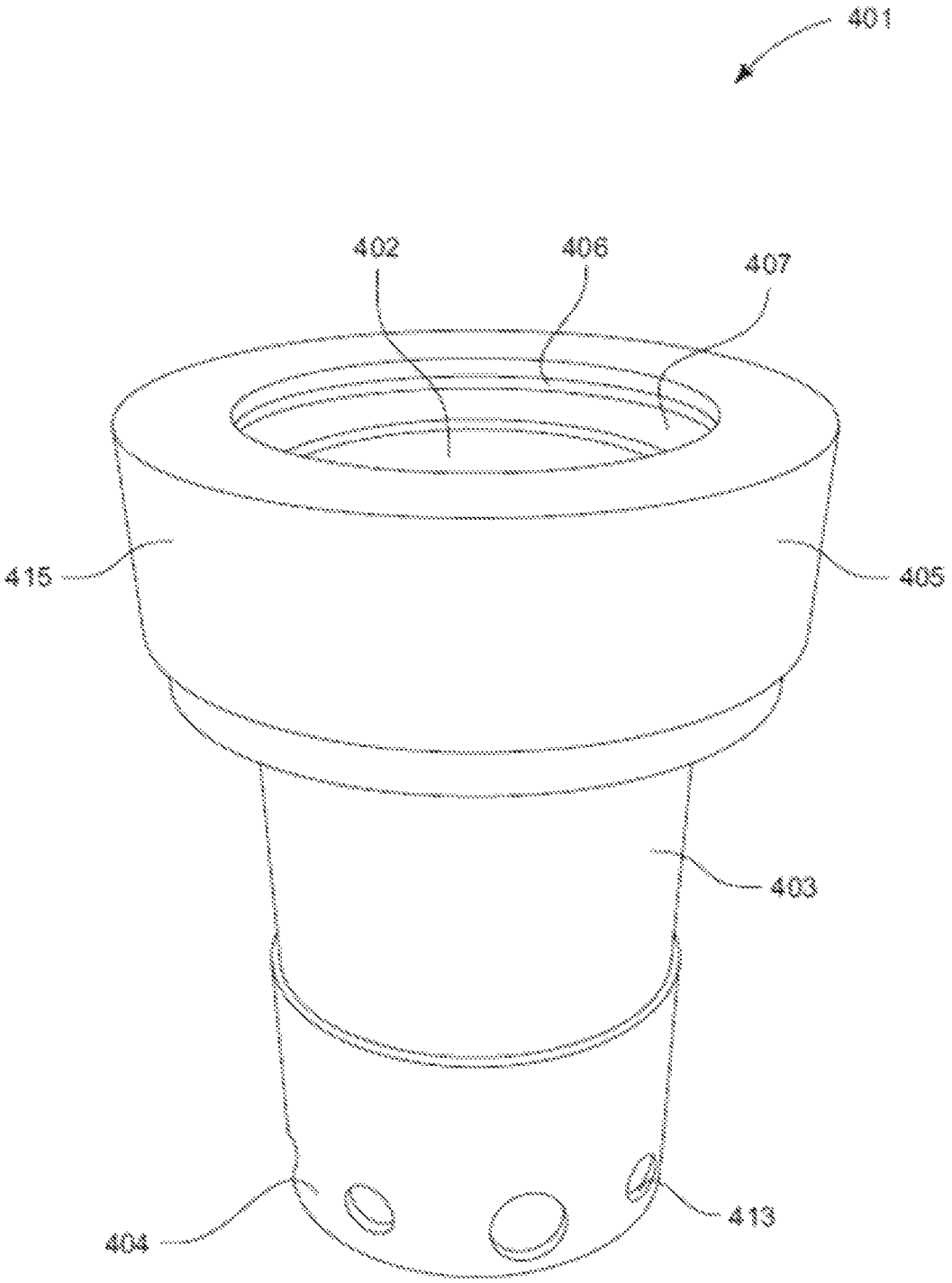
FIG. 4B depicts a sealing ring, according to one or more examples of the disclosure.
Figure 4C:
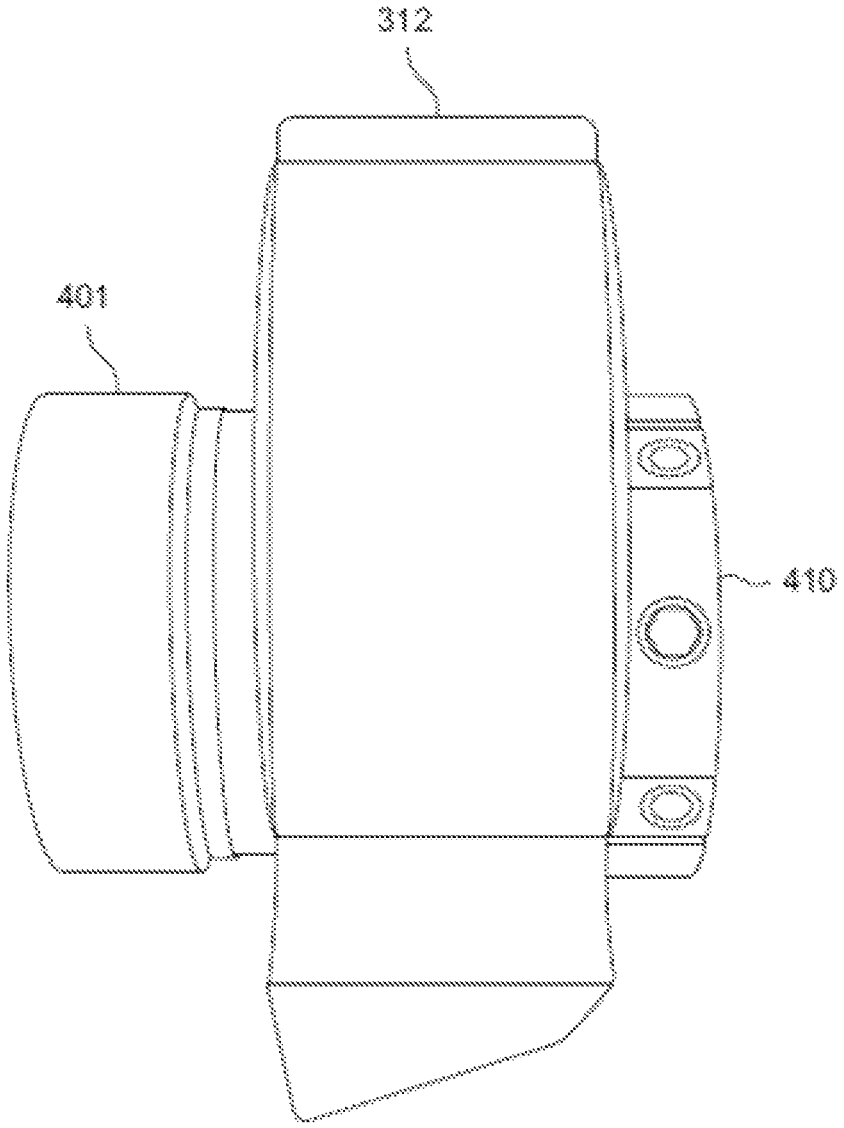
FIG. 4C depicts a fully assembled sealing set, according to one or more examples of the disclosure.

Second end 405 is illustrated from a different perspective in FIG. 4B. As can be seen in FIG. 4B, sealing ring 401 has head 415 defining second groove 406 circumscribed about the circumference of bore 402. Tubular body 403 also includes O-ring 407 disposed in second groove 406.

Referring back to FIG. 4A, setting ring 410 is positioned on the tubular body 403 in conjunction with O-ring 407. Setting ring 410 further defines a plurality of threaded holes 411. Setting ring 410 includes a plurality of set screws 412 (only one shown) that engage holes 413 (only one indicated) in tubular body 403 through threaded holes 411.

Referring back to FIG. 2, pump 100 also includes a one-piece bearing isolator 298. Although not shown in this example, in some embodiments pump 100 may also include a second one-piece bearing isolator that is similar (or identical to) one-piece bearing isolator 298. In this embodiment with two one-piece isolates, the second one-piece isolator may be positioned between bearings 266 and shaft sleeve 202. The second one-piece bearing isolator, when used, is oriented in the opposite direction relative to the pump shaft 207—i.e., in a direction 180° from the direction shown for the one-piece bearing isolator 298.

Figure 5A:
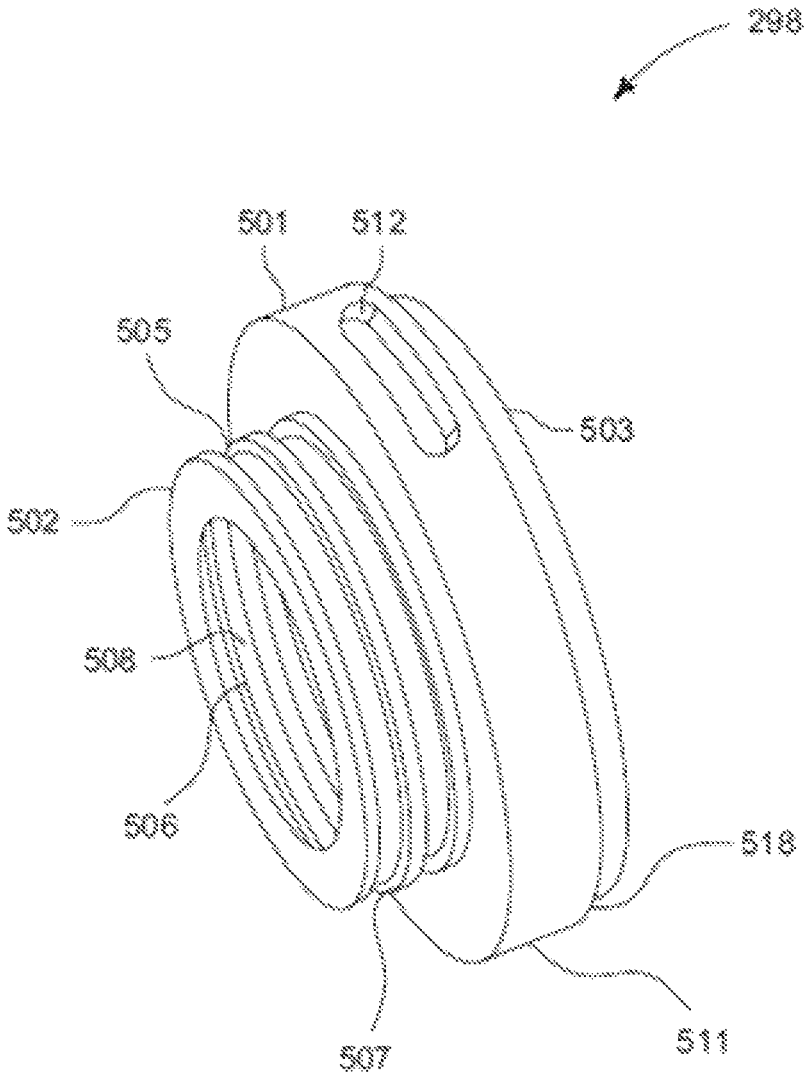
FIG. 5A depicts a one-piece bearing isolator, according to one or more examples of the disclosure.
Figure 5B:
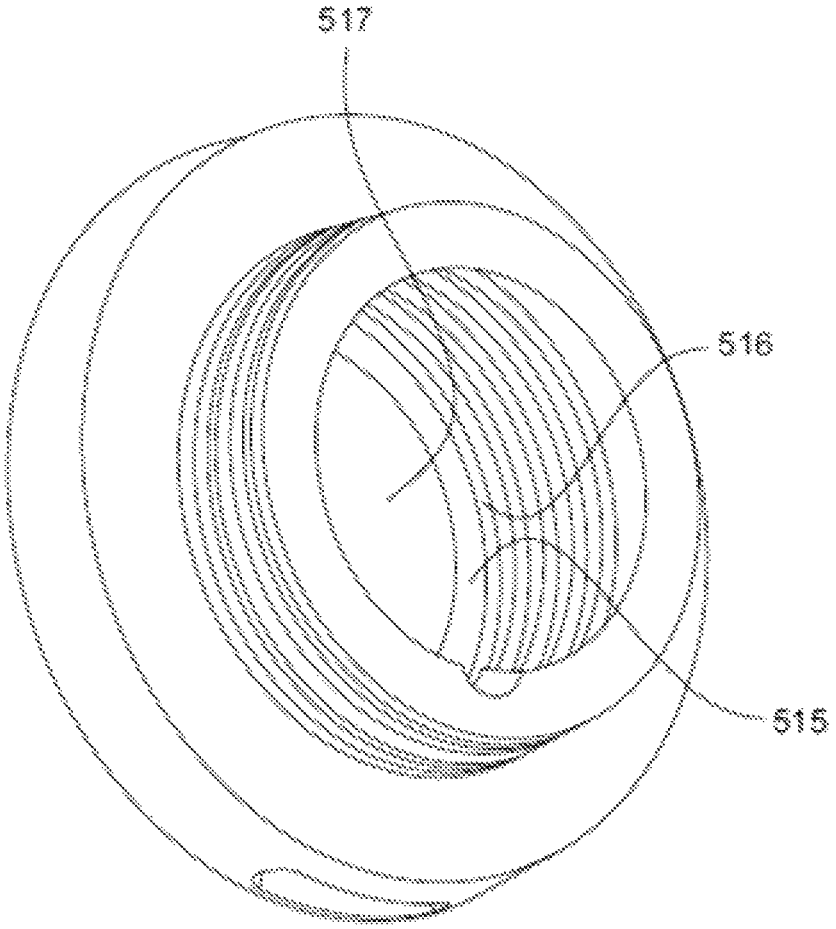
FIG. 5B depicts a top view of the one-piece bearing isolator of FIG. 5A, according to one or more examples of the disclosure.

Referring now to FIG. 5A-5B, one-piece bearing isolator 298 defines a bore 517 (shown in FIG. 5B). One-piece bearing isolator 298 includes stator 501. Stator 501 has a first end 502 from which a first set of grooves 505 on the outside of the stator 501 extend toward head 511. Stator 501 further includes a second set of grooves 506 that are on the inside of the stator 501 and extend from first end 502 toward head 511.

Stator 501 also includes a first set of O-rings 507 positioned in the first set of grooves 505, each of the first set of O-rings 507 being positioned in a respective one of the first set of grooves 505. Additionally, stator 501 includes a second set of O-rings 508 positioned in the second set of grooves 506, each of the second set of O-rings 508 being positioned in a respective one of the second set of grooves 506. Stator 501 has a second end 518 which includes head 511, with head 511 defining slot 512 positioned on the side of the head 511. As explained above, it is slot 512 through which leaked fluid will flow in operation.

As illustrated in FIG. 5A, one-piece bearing isolator 298 also includes rotor 503 seated in head 511 of stator 501. Rotor 503 has a recess 515 (visible in FIG. 5B) circumscribing the interior of rotor 503 (bore 517). Rotor 503 also has an O-ring 516 positioned in the recess 515.

Figure 5C:
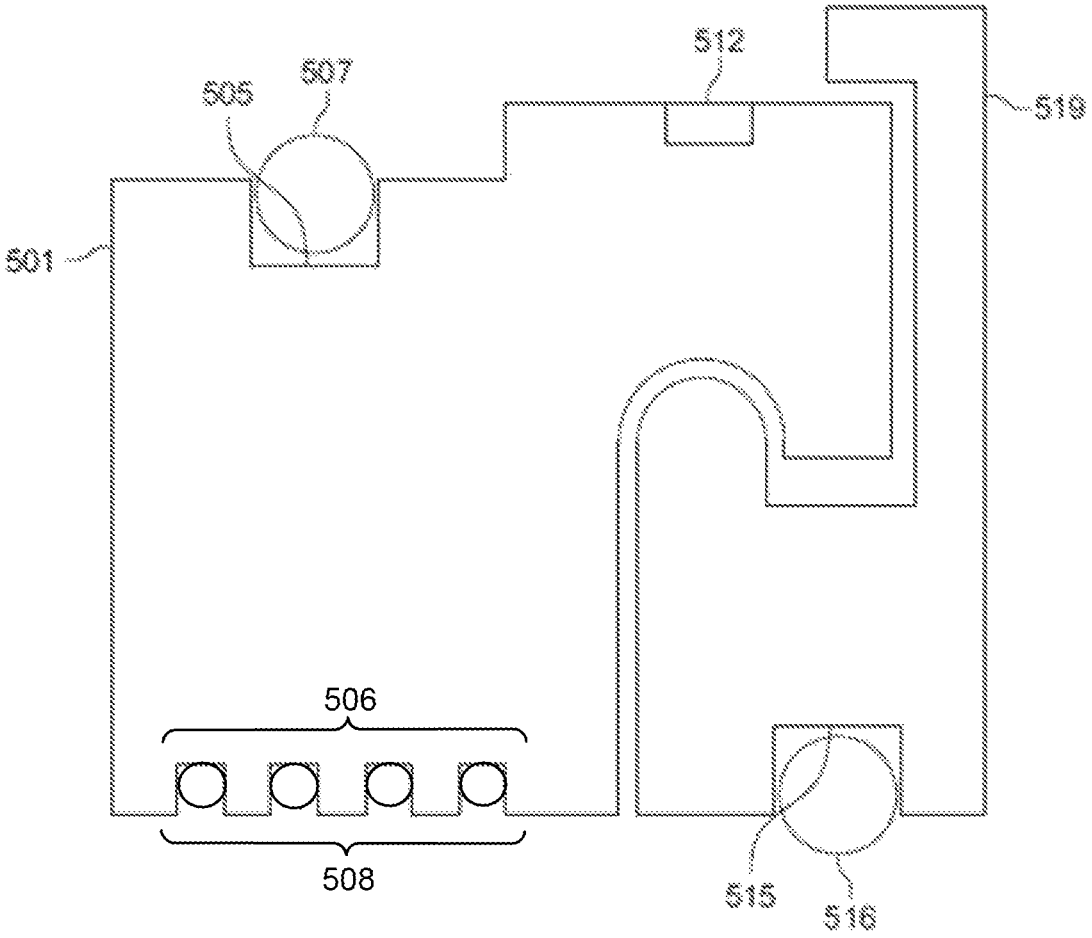
FIG. 5C depicts a cross-sectional view of a one-piece bearing isolator, according to one or more examples of the disclosure.

With reference to FIG. 5C, rotor 503 is designed to include, in some embodiments, a lip 519 extending over and hugging the head of stator 501. The first set of O-rings 507, the second set of O-rings 508, and the O-ring 516, in conjunction seal the bearings 266 protect against leaked fluid migrating along the pump shaft 207. As illustrated, one-piece bearing isolator 298 may be configured as a non-contact and non-wearing leak diverting device. In some implementations, one-piece bearing isolator 298 may be made of nylon (or other similar materials) to avoid fusion of its parts.

Figure 7:
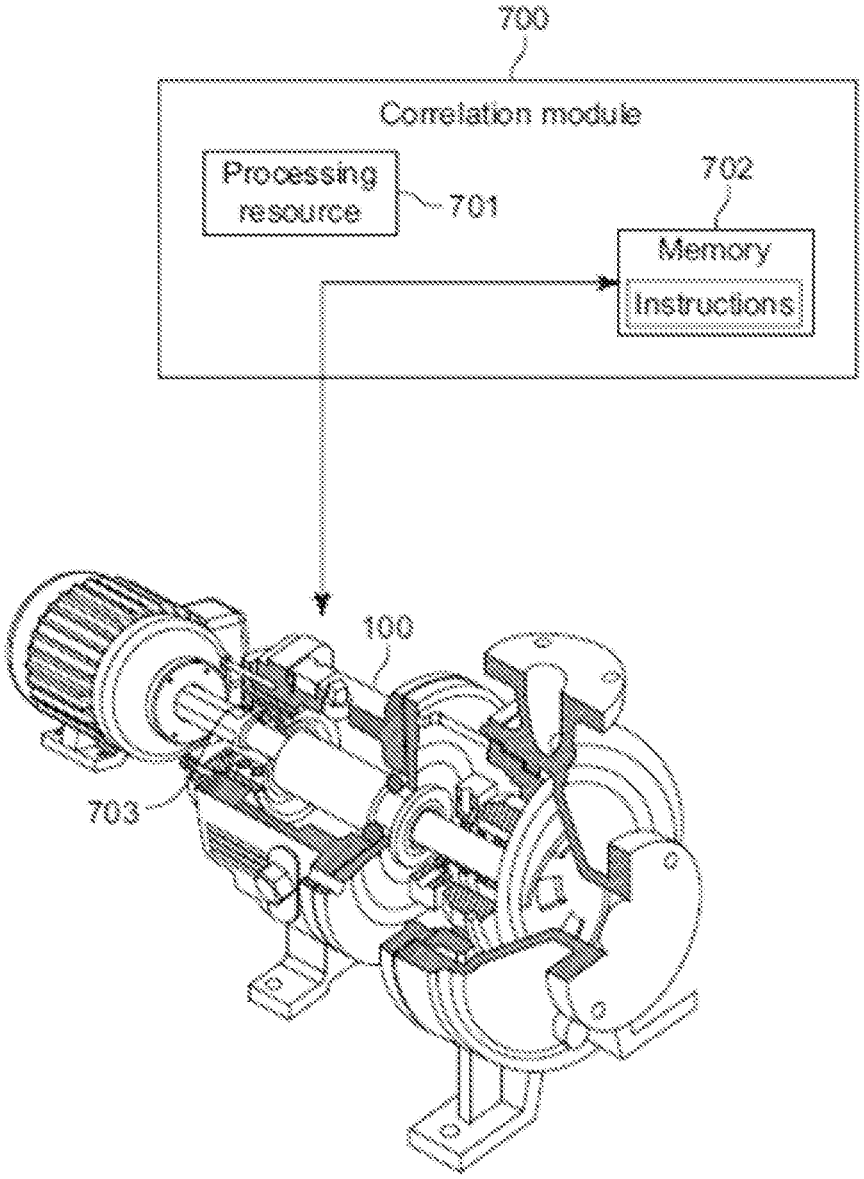
FIG. 7 depicts a modified pump, according to one or more examples of the disclosure.

Turning to FIG. 7, in some implementations (e.g., where monitoring of leaks is desired), pump 100 can also include a correlation module 700 that performs a correlation of fluid pressure and may provide information or an alarm to a network that may in turn be connected to client devices. Additionally, pump 100 can include a processing resource 701 connected to a memory 702, wherein the memory comprises pre-drafted alarms that notify a pump operator of a pump leak.

Pump 100 can also have a sensor 703 mounted on the pump, for example as illustrated in FIG. 7, sensor 703 may be mounted on pump shaft 207. Processing resource 701 with memory 702 may contain pre-set limits for fluid and instructions to perform actions with respect to those pre-set limits. Sensor 703 can be in electronic communication with a control system, for example a process control system, to activate an alarm based on the combination of pre-set limits and instruction actions.

In some cases, an alarm may notify an operator of the pump of a leakage or an amount of leakage over a threshold. In operation, once the operator is notified of a leakage via an alarm, the pump operator can decide to redirect the fluid leakage or can decide to shut down the pump entirely. The control system can also be set to automatically shut down the pump once a fluid leakage is detected, without requiring the actions of a pump operator.

With reference again to FIG. 2, pump 100 can, in some implementations, have a narrow fluid flow path. The narrow fluid flow path can have a close tolerance with shaft sleeve 202. Pump 100 can also include a drain 244 connected to a discharge nozzle 204 that may be used to drain leaked fluid away from pump 100. Pump 100 can also have the drain 244 for draining leaked fluid that may be collected in a containment vessel 209.

FIG. 6A-B depicts example methods for sealing a pump such as pump 100 in FIG. 1-FIG. 2. The method includes providing (at 600) a gland seal about the rotating shaft of a pump. The method also includes diverting (at 601) leakage through an outlet port in the gland seal through which leaked fluid drains out into a containment vessel. The method further includes providing (602) a one-piece bearing isolator about the rotating shaft of a pump, located downstream from the gland seal. The method further includes diverting (at 603) leakage through a slot in the one-piece bearing isolator through which leaked fluid drains (e.g., via a drain line such as drain 244) out into a containment vessel. The method can also include providing (at 604) a sealing set adjacent to the gland seal through which leaked fluid drains out into a containment vessel.

Returning now to FIG. 2, gland seal 200 and one-piece bearing isolator(s) 298, in conjunction, divert leaked fluid away from other more damaging areas of pump 100. More particularly, gland seal 200 and one-piece bearing isolator 298 form a seal about the pump shaft 207. Should fluids begin to leak, the seal about pump shaft 207 provided by gland seal 200 and one-piece isolator 298 working together may prevent leaked liquid fluids from traveling along pump shaft 207.

One-piece isolator 298, more particularly, may prevent leaked liquid fluid from traveling along pump shaft 207 into bearings 266. As stated above, leaked liquid fluid may be a cause of contamination for bearings 266, thus preventing this contamination (as provided by this disclosure) represents an improvement to the overall operation of a pump such as pump 100. As explained herein, use of the disclosed apparatus and methods divert any leaked liquid fluid through gland seal 200 toward drain 244 and ultimately to containment vessel 209. This diversion and collection may mitigate damage to pump 100 and to the environment in which pump 100 is deployed. Furthermore, the containment vessel 209 may be equipped with an additional sensor (not shown) through which an operator may be notified of any leak or fluid level within containment vessel 209.

The foregoing has outlined several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A gland seal comprising:
- a stationary seat defining:
  - an opening;
  - a recess circumscribing an interior of the opening;
  - a first groove adjacent to the recess and circumscribing the interior of the opening;
  - an inset surrounding the opening;
  - an inlet port where pressurized fluid enters the gland seal; and
  - an outlet port where leaked fluid exits the gland seal;
- a first O-ring disposed in the first groove;
- a rotating seal face disposed in the recess;
- a second O-ring disposed in the inset;
- a plurality of tabs disposed in the inset; and
- a spring retainer comprising:
  - a plurality of springs disposed on the spring retainer; and
  - a plurality of slots configured to mate with the plurality of tabs in the inset.

2. The gland seal of claim 1, further comprising, a sealing set, the sealing set comprising:
- a sealing ring defining a bore, the sealing ring comprising:
  - a tubular body comprising:
    - a first end defining a plurality of holes; and
    - a second end including:
      - a head defining a second groove circumscribed about the circumference of the bore; and
      - an O-ring disposed in the second groove;
  - a setting ring positioned on the tubular body, defining a plurality of threaded holes,
  - a plurality of set screws that engage the holes in the tubular body through the threaded holes.

3. The gland seal of claim 2, wherein the gland seal and sealing set are made of nylon.

4. A pump system including a pump, the pump system comprising:
- a motor positioned at one end of the pump;
- a shaft rotatable by the motor;
- an impeller including a plurality of blades, the blades mounted on and rotatable by the shaft;
- a shaft sleeve to protect the shaft as it passes through the pump;
- a plurality of bearings;
- packing for the plurality of bearings;
- a discharge nozzle;
- a gland seal comprising:
  - a stationary seat defining:
    - an opening;
    - a recess circumscribing an interior of the opening;
    - a first groove adjacent to the recess and circumscribing the interior of the opening;
    - an inset surrounding the opening;
    - an inlet port where pressurized fluid enters the gland seal; and
    - an outlet port where leaked fluid exits the gland seal;
  - a first O-ring disposed in the first groove;
  - a rotating seal face disposed in the recess;
  - a second O-ring disposed in the inset;
  - a plurality of tabs disposed in the inset;
  - a spring retainer comprising:
    - a plurality of springs disposed on the spring retainer; and
    - a plurality of slots configured to mate with the plurality of tabs; and
- a bearing isolator defining a first bore, the bearing isolator comprising:
  - a stator comprising:
    - a first end defining:
      - a first set of grooves on an outside of the stator;
      - a second set of grooves on an inside of the stator;
      - a first set of O-rings, each of the first set of O-rings being positioned in a respective one of the first set of grooves; and
      - a second set of O-rings, each of the second set of O-rings being positioned in a respective one of the second set of grooves;
    - a second end opposite the first end, the second end comprising:
      - a head; and
      - a slot positioned on the side of the head through which leaked fluid flows; and a rotor seated in the head of the stator, the rotor defining a recess circumscribing an interior of the rotor and comprising:

an O-ring positioned in the recess; and a lip extending over and hugging the head of the stator;

wherein the gland seal and the bearing isolator, in conjunction, divert leaked fluid away from the pump.

5. The pump system of claim 4, further comprising, a sealing set positioned on the shaft about the gland seal, the sealing set comprising:

a sealing ring defining a second bore, the sealing ring comprising:

a tubular body comprising:

a first end defining a plurality of holes; and a second end opposite the first end, the second end comprising:

a head defining a second groove circumscribed about the circumference of the second bore; and an O-ring disposed in the second groove; and a setting ring positioned on the tubular body, defining a plurality of threaded holes, and including a plurality of set screws that engage the holes in the tubular body through the threaded holes.

6. The pump system of claim 4, further comprising a correlation module processing unit that includes instructions to cause the processing unit to perform a correlation of fluid pressure and provide an alarm to a network connected to client devices.

7. The pump system of claim 4, further comprising a processor connected to a memory, wherein the memory comprises pre-drafted alarms to notify a pump operator of a pump leak.

8. The pump system of claim 4, further comprising a sensor mounted on the pump shaft and a processor with a memory, wherein the memory contains preset limits for fluid.

9. The pump system of claim 8, wherein the sensor is in electronic communication with a control system to activate an alarm.

10. The pump system of claim 4, further comprising a fluid flow path wherein the bearing isolator conforms to the fluid flow path.

11. The pump system of claim 10, wherein the fluid flow path has a tolerance with the shaft sleeve in addition to the bearing isolator.

12. The pump system of claim 4, further comprising a drain connected to a drain line to collect fluid, diverted by the working combination of the gland seal and the bearing isolator, away from the pump.

13. The pump system of claim 12, further comprising a containment vessel connected to the drain line to receive the diverted fluid.

* * * * *